US008282247B2

(12) United States Patent
Ivey et al.

(10) Patent No.: US 8,282,247 B2
(45) Date of Patent: Oct. 9, 2012

(54) METHOD OF FORMING LED-BASED LIGHT AND RESULTING LED-BASED LIGHT

(75) Inventors: John Ivey, Farmington Hills, MI (US); David L Simon, Grosse Pointe Woods, MI (US)

(73) Assignee: Ilumisys, Inc., Troy, MI (US)

( * ) Notice: Subject to any disclaimer, the term of this patent is extended or adjusted under 35 U.S.C. 154(b) by 0 days.

(21) Appl. No.: 13/153,818

(22) Filed: Jun. 6, 2011

(65) Prior Publication Data

US 2011/0235321 A1 Sep. 29, 2011

Related U.S. Application Data

(63) Continuation of application No. 12/169,918, filed on Jul. 9, 2008, now Pat. No. 7,976,196.

(51) Int. Cl.
*F21V 29/00* (2006.01)

(52) U.S. Cl. .... 362/294; 362/218; 362/373; 362/249.06

(58) Field of Classification Search ..... 362/218, 362/294, 373, 249.02, 249.06, 249.14
See application file for complete search history.

(56) References Cited

U.S. PATENT DOCUMENTS

2009/0316408 A1* 12/2009 Villard ..... 362/249.13

FOREIGN PATENT DOCUMENTS

KR 200430022 * 11/2006

* cited by examiner

*Primary Examiner* — Thomas Sember
(74) *Attorney, Agent, or Firm* — Young Basile

(57) ABSTRACT

A method of forming a LED-based light for replacing a conventional fluorescent bulb in a fluorescent light fixture includes forming a heat sink by shaping an elongate sheet of highly thermally conductive material to increase a surface area to width ratio thereof mounting LEDs in thermally conductive relation with the heat sink, and enclosing the LEDs within a light transmitting cover.

25 Claims, 4 Drawing Sheets

METHOD OF FORMING LED-BASED LIGHT AND RESULTING LED-BASED LIGHT

CROSS-REFERENCE TO RELATED APPLICATIONS

This application is a continuation of U.S. patent application Ser. No. 12/169,918, filed Jul. 9, 2008, which is incorporated herein by reference in its entirety.

TECHNICAL FIELD

The present invention relates to a light emitting diode (LED) based light for replacing a conventional fluorescent light in a fluorescent light fixture.

BACKGROUND

Fluorescent tube lights are widely used in a variety of locations, such as schools and office buildings. Fluorescent tube lights include a gas-filled glass tube. Although conventional fluorescent bulbs have certain advantages over, for example, incandescent lights, they also pose certain disadvantages including, inter alia, disposal problems due to the presence of toxic materials within the glass tube.

LED-based tube lights which can be used as one-for-one replacements for fluorescent tube lights have appeared in recent years. However, LEDs produce heat during operation that is detrimental to their performance. Some LED-based tube lights include heat sinks to dissipate the heat generated by the LEDs, and some of these heat sinks include projections for increasing the surface area of the heat sink. The heat sinks are formed by extruding billets of material, generally aluminum, through a die.

BRIEF SUMMARY

The present invention provides a LED-based replacement light including a heat sink having a high surface area to width ratio shaped from a flat sheet of thermally conductive material for replacing a conventional fluorescent light in a fluorescent fixture. Compared to an extruded heat sink of a conventional LED-based replacement light, shaping a heat sink from a sheet of highly thermally conductive material can result in a heat sink with a greater surface area to width ratio, and thus a greater ability to dissipate heat. Moreover, a shaped heat sink according to the present invention requires less material to produce and has a lower weight than an extruded heat sink. Further, a shaped heat sink according to the present invention can be produced less expensively than an extruded heat sink.

In general, embodiments of methods of manufacturing a LED-based light for replacing a conventional fluorescent bulb in a fluorescent light fixture and including a plurality of LEDs, an elongate heat sink, and an elongate light transmitting cover, are described herein. In one such embodiment, the method includes forming the heat sink by shaping an elongate sheet of highly thermally conductive material to increase the surface area to width ratio thereof. The method also includes mounting a plurality of LEDs in thermally conductive relation with the heat sink along its length, and enclosing the LEDs within a light transmitting cover.

In another embodiment, a LED-based light formed by the above method for replacing a conventional fluorescent bulb includes a light transmitting cover at least partially defining a tubular housing. A highly-thermally conductive heat sink is engaged with the cover. The heat sink has a high surface area to width ratio. LEDs are enclosed within the tubular housing and mounted in thermally conductive relation along a length of the heat sink for emitting light through the cover. At least one connector configured for physical connection to the fixture is at a longitudinal end of the tubular housing.

Embodiments of a method of manufacturing an elongate heat sink for use in a LED-based light for replacing a conventional fluorescent bulb in a fluorescent light fixture are also described. In one such embodiment, the method includes shaping the heat sink using a single elongate sheet of highly thermally conductive material, which has a width prior to shaping defined by a distance between a first longitudinally extending edge and an opposing second longitudinally extending edge, is shaped to include a plurality of integral longitudinally extending planar surfaces angled relative to one another. The width of the sheet prior to shaping is greater than a maximal width of the heat sink after shaping.

BRIEF DESCRIPTION OF THE DRAWINGS

The description herein makes reference to the accompanying drawings wherein like reference numerals refer to like parts throughout the several views, and wherein.

DETAILED DESCRIPTION OF EMBODIMENTS OF THE INVENTION

Figure 1:
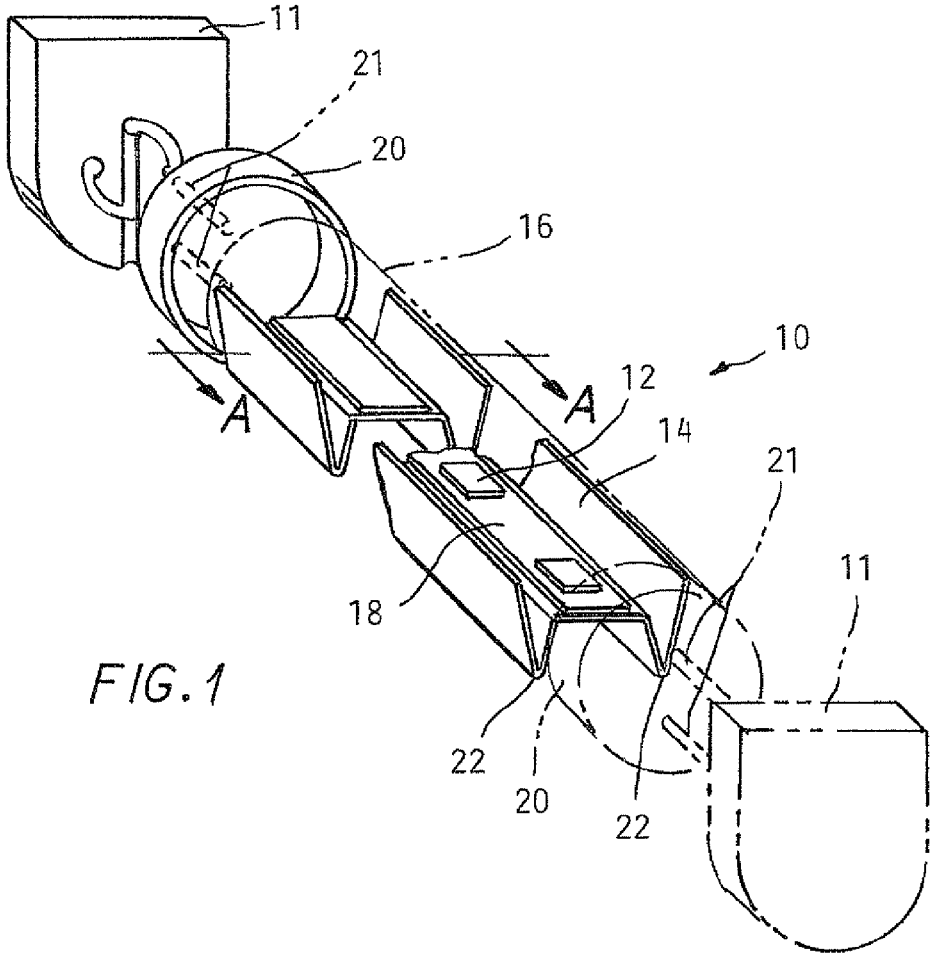
FIG. 1 is a perspective view of a LED-based replacement light with a heat sink having two longitudinal open fins.

Embodiments of a LED-based replacement light 10 according to the present invention are illustrated in FIGS. 1-11. In an embodiment of the light 10 illustrated in FIG. 1, the LED-based replacement light 10 includes LEDs 12, an elongate heat sink 14 shaped from a sheet of highly thermally conductive material, an elongate translucent tube 16, a circuit board 18, and end caps 20 carrying bi-pin connectors 21. The LED-based replacement light 10 can be dimensioned for use in a conventional fluorescent fixture 11. For example, the LED-based replacement light 10 can be 48" long with an approximately 1" diameter.

The LEDs 12 are preferably high-power, white light emitting LEDs 12, such as surface-mount devices of a type available from Nichia. The term "high-power" means LEDs 12 with power ratings of 0.25 watts or more. Preferably, the LEDs 12 have power ratings of one watt or more. However, LEDs with other power ratings, e.g., 0.05 W, 0.10 W, or 0.25 W, can alternatively be used. Although the LEDs 12 are shown as surface-mounted components, the LEDs 12 can be discrete components. Also, one or more organic LEDs can be used in place of or in addition to the surface-mounted LEDs 12. If desired, LEDs that emit blue light, ultra-violet light or other wavelengths of light, such as wavelengths with a frequency of 400-790 THz corresponding to the spectrum of visible light, can alternatively or additionally be included.

The LEDs 12 are mounted along the length of the circuit board 18 to uniformly emit light through a portion of the tube 16. The spacing between the LEDs 12 along the circuit board 18 can be a function of the length of the tube 16, the amount of light desired, the wattage of the LEDs 12, the number of LEDs 12, and the viewing angle of the LEDs 12. For a 48" light 10, the number of LEDs 12 may vary from about five to four hundred such that the light 10 outputs approximately 500 to 3,000 lumens, and the spacing between the LEDs 12 varies accordingly. The arrangement of LEDs 12 on the circuit board 18 can be such as to substantially fill the entire space between the end caps 20. However, LEDs 12 need not be spaced to emit light uniformly.

The circuit board 18 may be made in one piece or in longitudinal sections joined by electrical bridge connectors. The circuit board 18 is preferably one on which metalized conductor patterns can be formed in a process called "printing" to provide electrical connections from the pins 21 to the LEDs 12 and between the LEDs 12 themselves. An insulative board is typical, but other circuit board types, e.g., metal circuit boards, can alternatively be used. Alternatively, a circuit can be printed directly onto the heat sink 14 depending on the heat sink 14 material.

Figure 2:
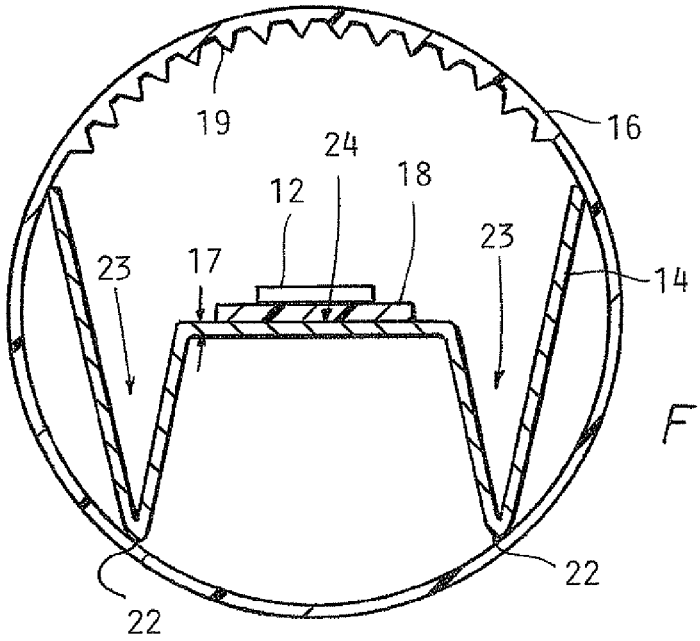
FIG. 2 is a cross-section view of FIG. 1 along line A-A.

FIG. 2 illustrates a cross-sectional view of the LED-based replacement light 10 of FIG. 1 along line A-A. A sheet of highly thermally conductive material has been shaped into a multi-planar, generally W-shape to fashion the heat sink 14. The process used to shape the sheet of material can be stamping, punching, deep drawing, bending, roll forming, forging, incremental sheet forming, thermoforming, or another sheet material shaping process. The specific process used can depend on the desired shape of the heat sink 14, the material properties of the sheet of flat material, and the production batch size. For example, punching may not be suitable to form a heat sink having a very high depth-to-width ratio, in which case deep drawing can be selected. As another example, certain plastics may not be sufficiently ductile for bending while at a normal room temperature and atmospheric pressure, but are formable using thermoforming. As a third example, roll forming may not be economical when a limited size production run is desired, in which case incremental sheet forming may be preferable. Additionally, multiple shaping processes can be carried out on the sheet of thermally conductive material to form a heat sink, examples of which are discussed later in regards to FIGS. 6 to 9. Also, the heat sink 14 need not be formed into a multi-planar shape. For example, the heat sink can have a curved profile if desired.

The heat conducting material can be aluminum, copper, an alloy, a highly thermally conductive plastic, a combination of materials (e.g., copper plated steel or a plastic impregnated with a metal powder filler), or another material known by one of skill in the art that can be shaped from a sheet to fashion the heat sink 14. The specific material used can depend on the heat generated by the LEDs 12, the thermal characteristics of the light 10, and the process used to shape the material. The material should be plastically deformable under shaping process conditions without fracturing. For example, if the heat sink 14 is to be formed by bending at room temperature and atmospheric pressure, a ductile material such as aluminum is preferably used.

The heat sink 14 can be shaped to include two longitudinally extending, open fins 22. Open fins 22 are portions of the sheet of material shaped into a "V", resulting in a space or cavity (hereinafter referred to as a depression 23) between the sides of each open fin 22. As a result, the sheet of material can have a width prior to shaping that is greater than the maximum width of the tube 16. Open fins 22 increase the surface area to width ratio of the heat sink 14, thereby increasing the ability of the heat sink 14 to dissipate heat. A high surface area to width ratio is a surface area to width ratio greater than twice the length of the heat sink 14 to one, by way of example and not limitation two and a half times the length of the heat sink 14 to one. Further, open fins 22 strengthen the heat sink 14. While the illustrated fins 22 extend longitudinally, with each fin 22 formed from two relatively obliquely angled integral lengths and of the heat sink 14 that converge at a generally pointed tip, alternative or additional fin shapes are possible. For example, the fins can extend radially instead of longitudinally, or the fins can have squared or U-shaped tips.

The heat sink 14 can also be shaped to include a longitudinally extending planar surface 24. The circuit board 18 can be mounted on the longitudinally extending planar surface 24 using thermally conductive adhesive transfer tape, glue, screws, a friction fit, and other attachments known to those of skill in the art. Thermal grease can be applied between the circuit board 18 and heat sink 14 if desired.

The tube 16 can be a hollow cylinder of polycarbonate, acrylic, glass, or another transparent or translucent material formed into a tubular shape by, for example, extrusion. The tube 16 can have a circular, oval, rectangular, polygonal, or other cross-sectional shape. The tube 16 can be clear or translucent. If the tube 16 is made of a high-dielectric material, the heat sink 14 is protected from unintentional contact that may transmit a charge resulting from capacitive coupling of the heat sink 14 and circuit board 18 resulting from a high frequency start-up voltage applied by the fixture 11 during installation of the light 10. However, the heat sink 14 receives less air flow when circumscribed by the tube 16. The manner in which the heat sink 14 and tube 16 are engaged depends on the structure of the particular heat sink 14 and tube 16. For example, as illustrated in FIG. 1, the heat sink 14 can be slidably inserted into the tube 16 and held in place by a friction fit. Alternatively, the heat sink 14 and tube 16 can be attached with glue, double-sided tape, fasteners, or other means known by those of skill in the art.

The light 10 can include features for uniformly distributing light to the environment to be illuminated in order to replicate the uniform light distribution of a conventional fluorescent bulb the light 10 is intended to replace. As described above, the spacing of the LEDs 12 can be designed for uniform light distribution. Additionally, the tube 16 can include light diffracting structures, such as the illustrated longitudinally extending ridges 19 formed on the interior of the tube 16. Alternatively, light diffracting structures can include dots, bumps, dimples, and other uneven surfaces formed on the interior or exterior of the tube 16. The light diffracting structures can be formed integrally with the tube 16, for example, by molding or extrusion, or the structures can be formed in a separate manufacturing step such as surface roughening. The light diffracting structures can be placed around an entire circumference of the tube 16, or the structures can be placed along an arc of the tube 16 through which a majority of light passes. In addition or alternative to the light diffracting structures, a light diffracting film can be applied to the exterior of the tube 16 or placed in the tube 16, or the material from which the tube 16 is formed can include light diffusing particles.

Alternatively to the tube 16 illustrated in FIGS. 1 and 2, the tube can be made from a flat or semi-cylindrical light transmitting cover extending a length and arc of the tube through which the LEDs 12 emit light and a semi-cylindrical dark body portion attached to the light transmitting portion. Due to its high infrared emissivity, the dark body portion dissipates a greater amount of heat to the ambient environment than a lighter colored body.

The end caps 20 as illustrated in FIGS. 1 and 2 carry bi-pin connectors 21 for physically and electrically connecting the LED-based replacement light 10 to the conventional fluorescent light fixture 11. Since the LEDs 12 are directionally oriented, the light 10 should be installed at a proper orientation relative to a space to be illuminated to achieve a desired illumination effect. Bi-pin connectors 21 allow only two light 10 installation orientations, thereby aiding proper orientation of the light 10. Also, only two of the four illustrated pins 21 must be active; two of the pins 21 can be "dummy pins" for physical but not electrical connection to the fixture 11. Alternative end caps can have different connectors, e.g., single pin connectors. Moreover, end caps 20 need not have a cup-shaped body that fits over a respective end of the tube 16. Alternative end caps can be press fit into the tube 16 or otherwise attached to the LED-based replacement light 10. Each end cap 20 can include a transformer, if necessary, and any other required electrical components to supply power to the LEDs 12. Alternatively, the electrical components can reside elsewhere in the LED-based replacement light 10.

Figure 3:
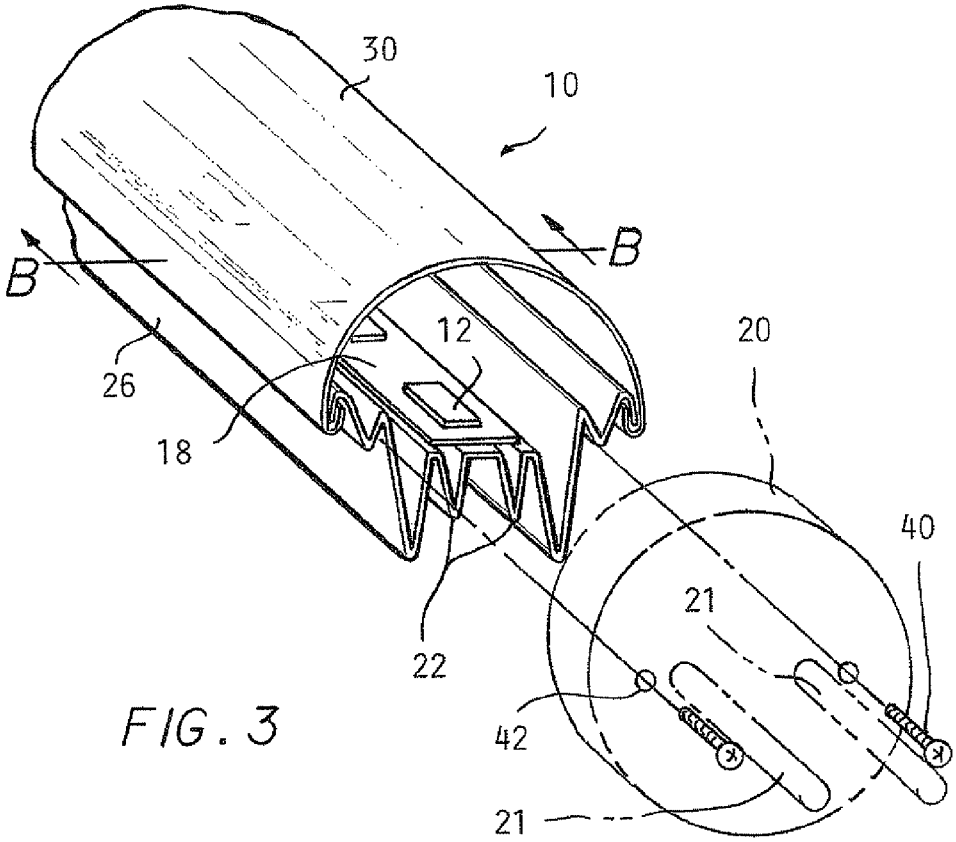
FIG. 3 is an exploded perspective view of a LED-based replacement light.
Figure 4:
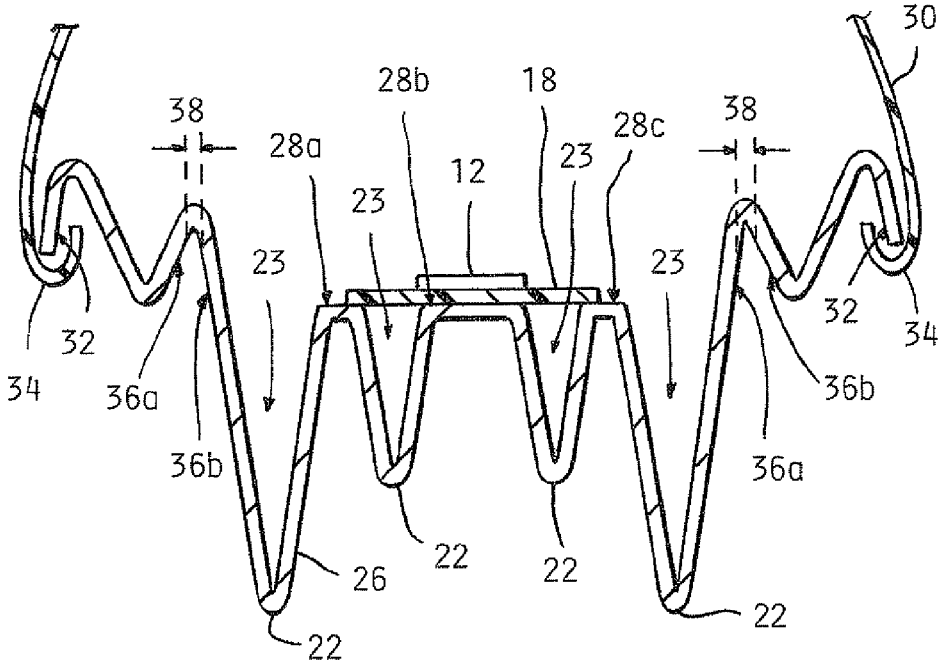
FIG. 4 is a cross-section view of FIG. 3 along line B-B.

FIGS. 3 and 4 illustrate another embodiment of the light 10 including a heat sink 26 shaped from a sheet of thermally conductive material and engaged with a light transmitting cover 30. The heat sink 26 is shaped to define three parallel planar surfaces 28*a*, 28*b* and 28*c* with two open fins 22 located between the respective adjacent surfaces. The circuit board 18 spans the fins 22 when mounted to the surfaces 28*a*, 28*b* and 28*c*. This configuration allows additional air flow to the circuit board 18 and increases the surface area of the heat sink 26. Alternatively, two or greater than three parallel planar surfaces separated by open fins 22 can be included.

The heat sink 26 can be shaped to include at least two longitudinally extending cover retaining surfaces 32. The cover 30 can include hooked longitudinal edges 34 that abut respective cover retaining surfaces 32 for engaging the cover 30 with the heat sink 26. The cover retaining surfaces 32 are preferably portions of the inside surfaces of lengths of the heat sink 26 that also define the longitudinal edges of the heat sink 26. When cover retaining surfaces 32 are portions of the inside surfaces of lengths of the heat sink 26 that also define longitudinal edges of the heat sink 26, a maximum area of the heat sink 26 remains exposed to the ambient environment surrounding the light 10 after engagement with the cover 30. Alternatively, the cover retaining surfaces 32 can be any surfaces abutted by the cover 30 for securing the cover 30 to the heat sink 26. For example, instead of the substantially U-shaped cover 30 illustrated in FIG. 3, the cover 30 can be nearly cylindrical with the hooked longitudinal edges 34 abutting adjacent cover retaining surfaces located near the middle of the width of a heat sink. Also, the cover retaining surfaces can have alternative shapes to the illustrated flat surfaces. For example, the cover retaining surface can form a groove if the cover includes a "tongue", such as a bulged longitudinal edge.

The heat sink 26 can also be shaped to include two sets of fastening surfaces 36*a* and 36*b* spaced apart in a direction perpendicular to the longitudinal axis of the heat sink 26. The two fastening surfaces 36*a* and 36*b* are spaced apart at a fastening location by a distance 38 substantially equal to a width of a fastener 40. The fastener 40 is inserted through an aperture 42 in the end cap 20, then friction fit, glued, screwed or otherwise attached between the two surfaces 36*a* and 36*b* for securing the end cap 20 to the heat sink 26. The exact distance 38 the fastening surfaces 36*a* and 36*b* are spaced apart depends on the type of fastener 40. For example, if the fastener 32 is a self-threading screw, the distance between the surfaces 36*a* and 36*b* can be slightly less than the width of the screw because the self-threading screw creates a concavity in each of the two fastening surfaces 36*a* and 36*b*, thereby preventing movement of the screw relative to the fastening surfaces 36*a* and 36*b*. The surfaces 36*a* and 36*b* can extend longitudinally the length of the heat sink 26 to permit the connection of an end cap 20 at each end of the LED-based replacement light 10, or the surfaces 36*a* and 36*b* can extend only a portion of the length from one or both ends of the heat sink 26. As shown, the end cap 20 has two apertures 42 for respective fasteners 40, but one or more than two connection points are also possible. Shaping the heat sink 26 to include fastening surfaces 36*a* and 36*b* eliminates the need for a separate manufacturing step to configure the heat sink 26 for attachment with end caps 20.

The cover 30 can be a semi-cylindrical piece of polycarbonate, acrylic, glass, or another translucent material shaped by, for example, extrusion. The cover 30 can have an arced, flat, bent, or other cross-sectional shape. As mentioned above, the cover 30 can include hooked longitudinal edges 34 or other edges configured for engagement with the heat sink 26. The cover 30 can be clear or translucent. The cover 30 can include light diffracting structures similar to the longitudinally extending ridges 19 illustrated in FIG. 2. Alternatively, light diffracting structures can include dots, bumps, dimples, and other uneven surfaces formed on the interior or exterior of the cover 30. The light diffracting structures can be placed around an entire circumference of the cover 30, or the structures can be placed along an arc of the cover 30 through which a majority of light passes. In addition or alternative to the light diffracting structures, a light diffracting film can be applied to the exterior of the cover 30 or placed between the cover 30 and the heat sink 26, or the material from which the cover 30 is formed can include light diffusing particles.

The heat sink 26 and cover 30 are engaged by abutting the hooked longitudinal edges 34 with the cover retaining surface 32. This can be accomplished by sliding the heat sink 26 relative to the cover 30 or, if the cover 30 is made from a flexible material, abutting one hooked edge 34 of the cover with a retaining surface 32 of the heat sink 26, then flexing cover 30 to abut the other hooked edge 34 with the other retaining surface 32. Alternatively, the heat sink 26 and cover 30 can be screwed, glued, taped, or attached with other attachments known to those of skill in the art.

Since the heat sink 26 includes a large area exposed to the ambient environment, the heat transfer properties of the heat sink 26 are good. However, if the heat sink 26 is formed of an electrically conductive material, capacitive coupling between the heat sink 26 and circuit board 18 presents a shock hazard potential as described above. This problem can be reduced or eliminated by shaping the heat sink 26 from a sheet of high-dielectric heat conducting material, such as a D-Series material by Cool Polymers of Warwick, R.I.

Figure 5:
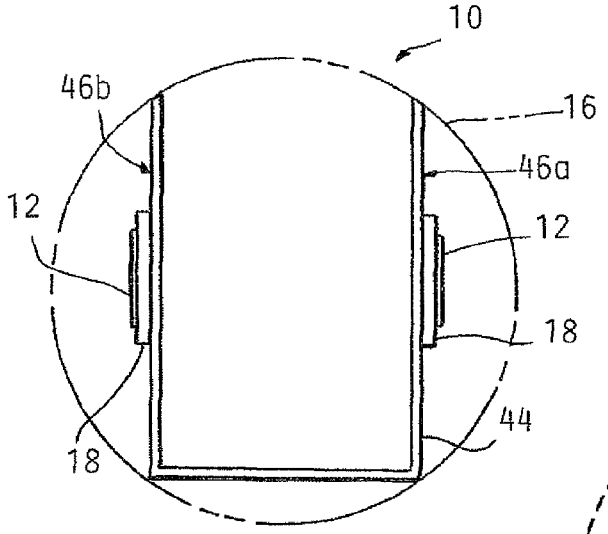
FIG. 5 is an end view of a heat sink having opposing facing LEDs positioned in a tube.

FIG. 5 illustrates another example of a heat sink 44 according to the present invention inserted in the tube 16. The heat sink 44 can be shaped to include multiple planar surfaces 46*a* and 46*b* angled relative to one another. As illustrated, the planar surfaces 46*a* and 46*b* are angled at 180° relative to one another. This formation permits two circuit boards 18 carrying LEDs 12 to be mounted facing opposite directions, thereby providing light around a greater amount of the circumference of the tube 16 than the LED-based replacement lights 10 illustrated in FIGS. 1-4. Alternatively, more than two planar surfaces can be included, and the surfaces can be angled relative to one another at angles other than 180°. For example, the heat sink can be circular, hexagonal, or have a different polygonal shape.

Figure 6:
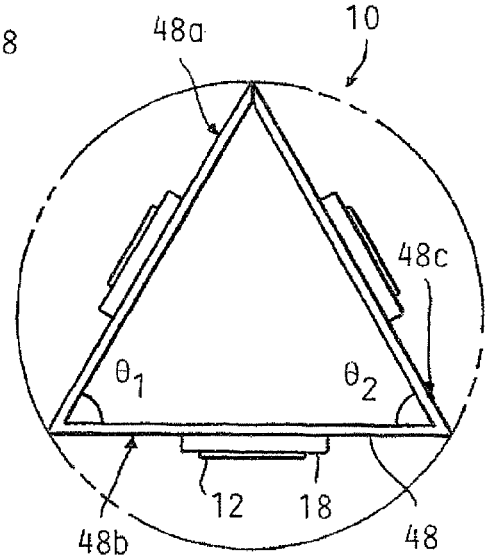
FIG. 6 is an end view of a triangular heat sink positioned in a tube.
Figure 7:
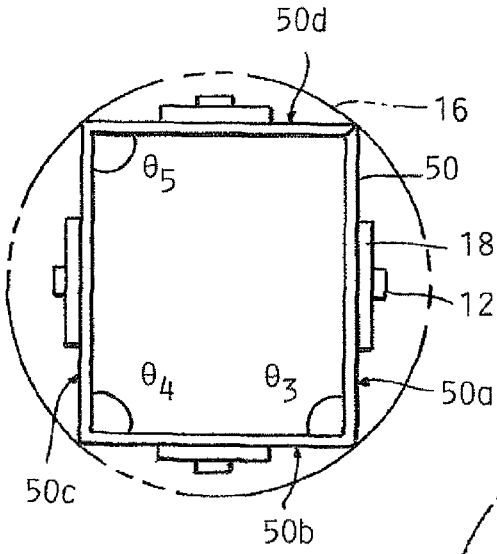
FIG. 7 is an end view of a rectangular heat sink positioned in a tube.

Heat sinks can undergo additional manufacturing steps prior to or following shaping. FIG. 6 illustrates an embodiment of the light 10 including a heat sink 48 having a triangular cross-section. In order to form the heat sink 48 into a triangle, the heat sink 48 is shaped to form an angle $\theta_1$ between sides 48*a* and 48*b*. In a separate shaping operation, side 48*b* is bent at an angle $\theta_2$ to form side 48*c*. Similarly, FIG. 7 illustrates a square heat sink 50. The square heat sink 50 is formed by shaping an angle $\theta_3$ between sides 50*a* and 50*b* and an angle $\theta_4$ between sides 50*b* and 50*c*. In a separate shaping operation, side 50*c* is bent at an angle $\theta_5$ to form side 50*d*. Thus, by performing multiple shaping operations, the heat sink 50 can include sides 50*a-d* facing around the entire circumference of the tube 16.

Figure 8:
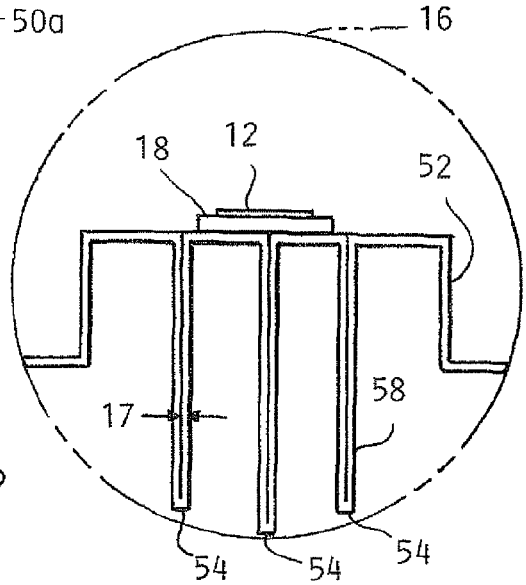
FIG. 8 is an end view of a first compressed heat sink in a tube.
Figure 9:
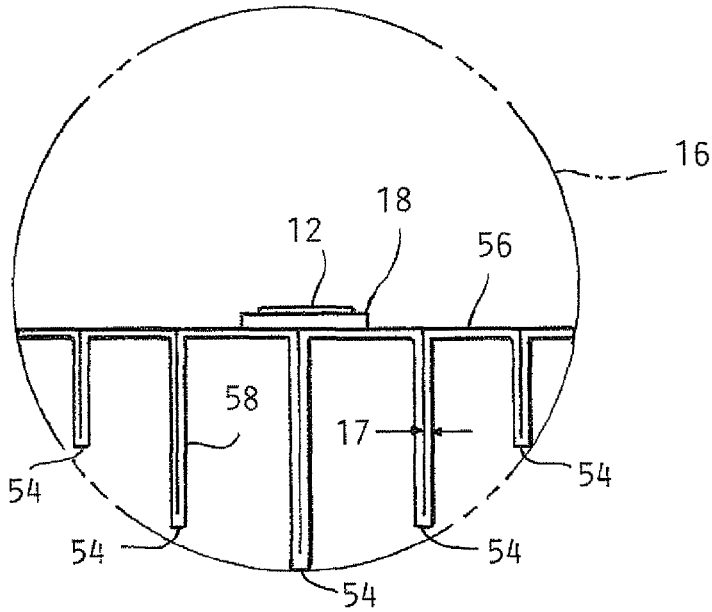
FIG. 9 is an end view of a second compressed heat sink in a tube.

After shaping, heat sinks can be compressed to form different shapes. FIGS. 8 and 9 illustrate examples of compressed heat sinks 52 and 56, respectively. After shaping a sheet of highly thermally conductive material to include open fins 22 defining a depression 23 as previously described, the shaped sheet can be compressed in a direction perpendicular to the longitudinal axis of the tube 18 to form heat sinks 52 and 56. By compressing the sheet of material shaped to include fins 22 defining depressions 23, the depressions 23 between the fins 22 are minimized or eliminated. The resulting closed fins 54 are twice the thickness 17 of the sheet of material since each closed fin 54 includes two parallel plies of the material abutting one another. Alternatively, compression can occur in a different direction, e.g., parallel to the longitudinal axis of the tube 18, depending on the orientation of the open fins 22. Thermal grease 58 can be applied in each depression 23 prior to compression, if desired.

Figure 10:
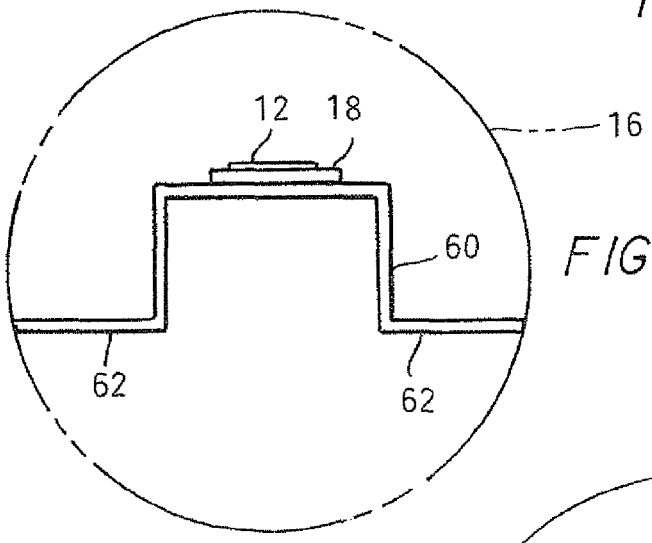
FIG. 10 is an end view of a first stepped heat sink in a tube.
Figure 11:
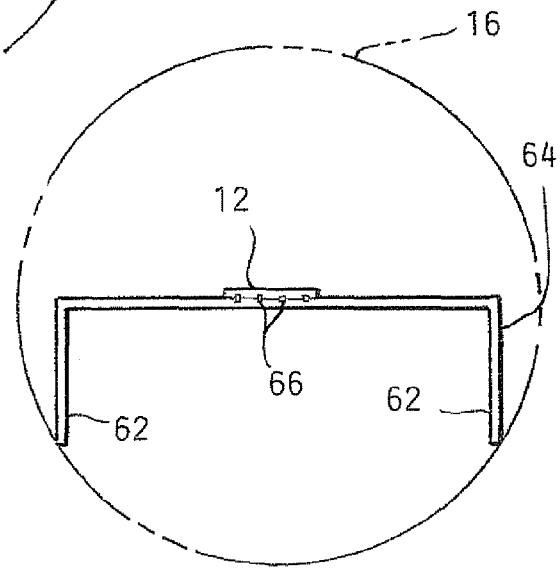
FIG. 11 is an end view of a second stepped heat sink in a tube.

Additional embodiments of the light 10 include heat sinks shaped to include stepped fins 62. For example, FIGS. 10 and 11 illustrate stepped heat sinks 60 and 64, respectively, with stepped fins 62 formed along the longitudinal edges of the heat sinks 60 and 64. Stepped fins 62 increase the surface area of the heat sinks 60 and 64 compared to a simple planar heat sink.

Also as illustrated in FIG. 11, connectors 66 are printed directly onto the heat sink 64 instead of using a circuit board 18. The heat sink 64 can be made of a high-dielectric material to avoid a short circuit.

Shaping a sheet of highly thermally conductive material to form a heat sink has several advantages compared to a conventional extruded heat sink. A shaped heat sink according to the present invention can be less expensive to manufacture than a conventional extruded heat sink. A shaped heat sink can simplify assembly of the light 10 by integrally including structures for connecting a cover 30 and end caps 20. A shaped heat sink can have a high surface area to width ratio to transfer heat from LEDs 12 to an ambient environment surrounding the light 10. A shaped heat sink can include multiple planar surfaces for mounting circuit boards 18 facing in different directions, thereby allowing LEDs 12 to emit light more uniformly around an arc of the LED-based replacement light 10 than known heat sinks. A shaped heat sink can be enclosed in a tube 16 or be made from a highly thermally conductive dielectric material to reduce a shock hazard potential due to capacitive coupling of a metal heat sink positioned adjacent a circuit board.

The above-described embodiments have been described in order to allow easy understanding of the invention and do not limit the invention. On the contrary, the invention is intended to cover various modifications and equivalent arrangements included within the scope of the appended claims, which scope is to be accorded the broadest interpretation so as to encompass all such modifications and equivalent structures as is permitted under the law.

What is claimed is:

1. A method of forming a LED-based light for replacing a conventional fluorescent bulb in a fluorescent light fixture and including a plurality of LEDs, an elongate heat sink, and an elongate light transmitting cover, the method comprising:

providing the heat sink by shaping an elongate sheet of highly thermally conductive material having opposing longitudinally extending edges to increase a surface area to width ratio thereof;

mounting the LEDs in thermally conductive relation with the heat sink; and enclosing the LEDs within the light transmitting cover such that the longitudinally extending edges engage an interior of the cover to support the heat sink within the cover.

2. The method of claim 1, wherein shaping the elongate sheet is performed using at least one of stamping, punching, deep drawing, bending, roll forming, forging, incremental sheet forming or thermoforming.

3. The method of claim 1, wherein shaping the heat sink is performed without extruding the elongate sheet.

4. The method of claim 1, wherein forming the heat sink by shaping further comprises:

shaping the elongate sheet to form fins in the heat sink.

5. The method of claim 4, wherein the fins are open.

6. The method of claim 5, wherein the fins are stepped.

7. The method of claim 4, wherein the fins are closed.

8. The method of claim 4, wherein forming the heat sink by shaping further comprises:

shaping at least one longitudinally extending open fin into heat sink; and compressing the heat sink in a direction perpendicular to the longitudinally extending open fin to close the open fin.

9. The method of claim 1, further comprising:

shaping at least one longitudinally extending planar surface into the heat sink;

mounting the LEDs to a circuit board; and attaching the circuit board to the at least one planar surface.

10. The method of claim 9, further comprising:

shaping at least one longitudinally extending open fin into the at least one planar surface for dividing the at least one planar surface into two parallel planar surfaces separated by a depression;

compressing the heat sink in a direction perpendicular to the longitudinally extending open fin to close the open fin; and mounting the circuit board on the two parallel planar surfaces.

11. The method of claim 9, further comprising:

shaping multiple longitudinally extending planar surfaces angled relative to one another into the heat sink; and mounting a first group of LEDs on a first of the multiple planar surfaces and mounting a second group of LEDs on a second of the multiple planar surfaces.

12. The method of claim 11, wherein the first planar surface and second planar surface are angled apart from one another by approximately one of 60°, 90° and 180°.

13. The method of claim 1, further comprising:

shaping the heat sink to include two surfaces spaced apart in a direction perpendicular to a longitudinal axis of the heat sink by a distance substantially equal to a width of a fastener; and securing the fastener between the two surfaces for attaching an end cap to the heat sink.

14. The method of claim 1, further comprising:

shaping the heat sink to have a high surface area to width ratio and a substantially constant thickness; and attaching at least one electrical connector adjacent a longitudinal end of the heat sink.

15. A LED-based light for replacing a conventional fluorescent bulb in a fluorescent light fixture formed according to the method of claim 1, wherein:

the light transmitting cover at least partially defines a tubular housing;

the heat sink has a high surface area to width ratio;

the LEDs are enclosed within the tubular housing and mounted in thermally conductive relation along a length of the heat sink for emitting light through the cover; and at least one connector configured for physical connection to the fixture is attached at a longitudinal end of the tubular housing.

16. The LED-based light of claim 15, wherein:

the at least one connector is further configured for electrical connection to the fixture; and the at least one connector is in electrical communication with the LEDs.

17. The LED-based light of claim 15, wherein the heat sink has a substantially constant thickness.

18. The LED-based light of claim 15, wherein the heat sink defines at least one open fin.

19. The LED-based light of claim 15, wherein the heat sink includes a longitudinally extending planar surface, and wherein the at least one LED is mounted to an elongate circuit board secured to the planar surface.

20. The LED-based light of claim 15, wherein the heat sink includes two surfaces spaced apart in a direction perpendicular to the length the heat sink by a distance substantially equal to a width of a fastener for securing the at least one connector to the heat sink, and wherein the at least one connector is secured to the heat sink by engaging the fastener between the two surfaces.

21. The LED-based light of claim 15, wherein the heat sink includes multiple longitudinally extending planar surfaces angled relative to one another for securing a plurality of circuit boards in different orientations onto the heat sink; and a first group of LEDs mounted on a first of the multiple planar surfaces and a second group of LEDs on a second of the multiple planar surfaces.

22. A method of manufacturing an elongate heat sink for use in a LED-based light for replacing a conventional fluorescent bulb in a fluorescent light fixture, the method comprising:

shaping, to form the heat sink, a single elongate sheet of highly thermally conductive material having a width prior to shaping defined by a distance between a first longitudinally extending edge and an opposing second longitudinally extending edge to include a plurality of integral longitudinally extending planar surfaces angled relative to one another, wherein:

the width of the sheet prior to shaping is greater than a maximal width of the heat sink after shaping, and the heat sink is shaped such that the opposing longitudinally extending edges are configured to engage an interior of a light transmitting cover to support the heat sink within the cover.

23. The method of claim 22, wherein shaping the elongate sheet is performed using at least one of stamping, punching, deep drawing, bending, roll forming, forging, incremental sheet forming or thermoforming.

24. The method of claim 22, wherein shaping the elongate sheet is performed without extruding the elongate sheet.

25. The method of claim 22, further comprising:

shaping multiple longitudinally extending planar surfaces into the heat sink, wherein the longitudinally extending planar surfaces are angled relative to one another by approximately 90°, such that stepped fins are formed in the heat sink.

* * * * *